US007368023B2

(12) United States Patent
Chang et al.

(10) Patent No.: US 7,368,023 B2
(45) Date of Patent: May 6, 2008

(54) ZIRCONIUM-RICH BULK METALLIC GLASS ALLOYS

(75) Inventors: Y. Austin Chang, Middleton, WI (US); Hongbo Cao, Madison, WI (US); Dong Ma, Madison, WI (US); Ling Ding, Pittsburgh, PA (US); Ker-chang Hsieh, Kaohsiung (TW)

(73) Assignee: Wisconisn Alumni Research Foundation, Madison, WI (US)

( * ) Notice: Subject to any disclaimer, the term of this patent is extended or adjusted under 35 U.S.C. 154(b) by 398 days.

(21) Appl. No.: 10/963,413

(22) Filed: Oct. 12, 2004

(65) Prior Publication Data

US 2006/0076089 A1 Apr. 13, 2006

(51) Int. Cl.
*C22C 45/10* (2006.01)

(52) U.S. Cl. ..... 148/403; 148/421; 420/423

(58) Field of Classification Search ..... 148/403
See application file for complete search history.

(56) References Cited

U.S. PATENT DOCUMENTS

| | | | | |
|---|---|---|---|---|
| 3,989,517 | A | 11/1976 | Tanner et al. | |
| 4,050,931 | A | 9/1977 | Tanner et al. | |
| 4,298,382 | A | 11/1981 | Stempin et al. | |
| 4,339,255 | A | 7/1982 | Ovshinsky et al. | |
| 4,581,081 | A | 4/1986 | Kroeger et al. | |
| 5,288,344 | A | 2/1994 | Peker et al. | |
| 5,368,659 | A | 11/1994 | Peker et al. | |
| 5,547,484 | A | 8/1996 | Vianco et al. | |
| 5,618,359 | A | 4/1997 | Lin et al. | |
| 5,735,975 | A | 4/1998 | Lin et al. | |
| 5,740,854 | A | 4/1998 | Inoue et al. | |
| 5,896,642 | A | 4/1999 | Peker et al. | |
| 5,976,274 | A | 11/1999 | Inoue et al. | |
| 5,980,652 | A * | 11/1999 | Inoue et al. | 148/403 |
| 6,074,497 | A | 6/2000 | Inoue et al. | |
| 6,106,376 | A | 8/2000 | Rybak et al. | |
| 6,231,697 | B1 | 5/2001 | Inoue et al. | |
| 6,427,753 | B1 | 8/2002 | Inoue et al. | |
| 6,562,156 | B2 | 5/2003 | Liu | |
| 6,592,689 | B2 | 7/2003 | Hays | |
| 6,623,566 | B1 | 9/2003 | Senkov et al. | |
| 6,652,673 | B1 | 11/2003 | Inoue et al. | |
| 6,652,679 | B1 | 11/2003 | Inoue et al. | |
| 6,682,611 | B2 | 1/2004 | Zhang et al. | |
| 6,692,590 | B2 | 2/2004 | Xing et al. | |
| 6,695,936 | B2 | 2/2004 | Johnson | |
| 2003/0024616 | A1 * | 2/2003 | Kim et al. | 148/561 |

OTHER PUBLICATIONS

Yan, et al., "A thermodynamic approach for predicting the tendency of multicomponent metallic alloys for glass formation." *Intermetallics,* 9: pp. 535-538, 2001. Published by Elsevier.

* cited by examiner

*Primary Examiner*—George Wyszomierski
(74) *Attorney, Agent, or Firm*—Foley & Lardner LLP

(57) ABSTRACT

Zirconium-rich bulk metallic glass alloys include quinary alloys containing zirconium, aluminum, titanium, copper and nickel. The bulk metallic glass alloys may be provided as completely amorphous pieces having cross-sectional diameters of at least about 5 mm or even greater.

42 Claims, 2 Drawing Sheets

ZIRCONIUM-RICH BULK METALLIC GLASS ALLOYS

STATEMENT OF GOVERNMENT RIGHTS

Research funding was provided for this invention by the United States-Department of Defense Advanced Research Projects Agency (DOD ARPA) under grant No. DAAD 19-01-0525. The United States government has certain rights in this invention.

FIELD OF THE INVENTION

The present invention relates to zirconium-rich bulk metallic glasses. More specifically, the invention relates to quinary bulk metallic glasses composed of zirconium, aluminum, titanium, copper and nickel.

BACKGROUND OF THE INVENTION

Bulk metallic glasses (BMGs) exhibit unique properties such as high strength (≈300 ksi or 2 GPa), excellent wear and corrosion resistance, high fracture toughness (e.g., 50 MPa $m^{1/2}$), outstanding castability, and low cost for alloy preparation and fabrication. These properties make them extremely attractive as materials which have great potential for practical applications. The success in making BMGs originated from the primary work of Duwez and co-workers in 1960 to synthesize metallic glass (or amorphous) oils by rapidly quenching a liquid gold-silicon alloy with cooling rates in the order of $10^5$-$10^6$ K/s. Subsequent advances have been made for synthesizing BMGs with a 5 to 6 orders of magnitude reduction in the cooling rate in the period from the 1980s to the 1990s. One of the only commercially available bulk metallic glasses currently on the market is sold under the trade name Vitreloy 1. Vitreloy 1 is a five component zirconium (Zr)-titanium (Ti)-copper (Cu)-nickel (Ni)-beryllium (Be) alloy that has been cast commercially using conventional technology to fabricate BMG components. However, a continued need exists for more zirconium-rich bulk metallic glass alloys.

SUMMARY OF THE INVENTION

The present invention encompasses zirconium-rich bulk metallic glass alloys. The alloys contain zirconium (Zr), aluminum (Al), titanium (Ti), copper (Cu) and nickel (Ni). The alloys in accordance with the invention provide high strength, high fracture toughness, good castability and excellent wear and corrosion resistance.

One aspect of the invention provides bulk metallic glass pieces made from amorphous alloys that include about 28 to 45 atomic percent copper, about 1 to 12 atomic percent nickel, about 1 to 15 atomic percent aluminum, about 0.05 to 10 atomic percent titanium and about 35 to 70 atomic percent zirconium where the content of copper plus nickel in the alloys is about 29 to 50 atomic percent.

The present invention further includes bulk metallic glass alloy pieces made from amorphous alloys that include about 0.1 to 3 atomic percent copper, about 18 to 25 atomic percent nickel, about 0.5 to 3 atomic percent aluminum, about 5 to 10 atomic percent titanium, and about 60 to 70 atomic percent zirconium.

The present invention further provides bulk metallic glass alloy pieces made from amorphous alloys composed of about 20 to 30 atomic percent copper, about 0.01 to 4 atomic percent nickel, about 5 to 15 atomic percent aluminum, about 0.5 to 5 atomic percent titanium and about 55 to 65 atomic percent zirconium.

The invention also includes bulk metallic glass alloy pieces made from amorphous alloys composed of about 0.5 to 25 atomic percent copper, about 20 to 60 atomic percent nickel, about 0.1 to about 15 atomic percent aluminum, about 10 to 30 atomic percent titanium and about 15 to 30 atomic percent zirconium.

In some embodiments the bulk metallic glasses provided herein are quinary systems that are free of or substantially free of (e.g., contain no more than about 0.2 atomic percent and desirably no more than about 0.1 atomic percent) other transition metals.

In some embodiments the bulk metallic glasses provided herein are free of or substantially free of at least one of beryllium or tantalum.

Further objects, features and advantages of the invention will be apparent from the following description when taken in conjunction with the accompanying drawings.

DETAILED DESCRIPTION OF THE INVENTION

Figure 1:
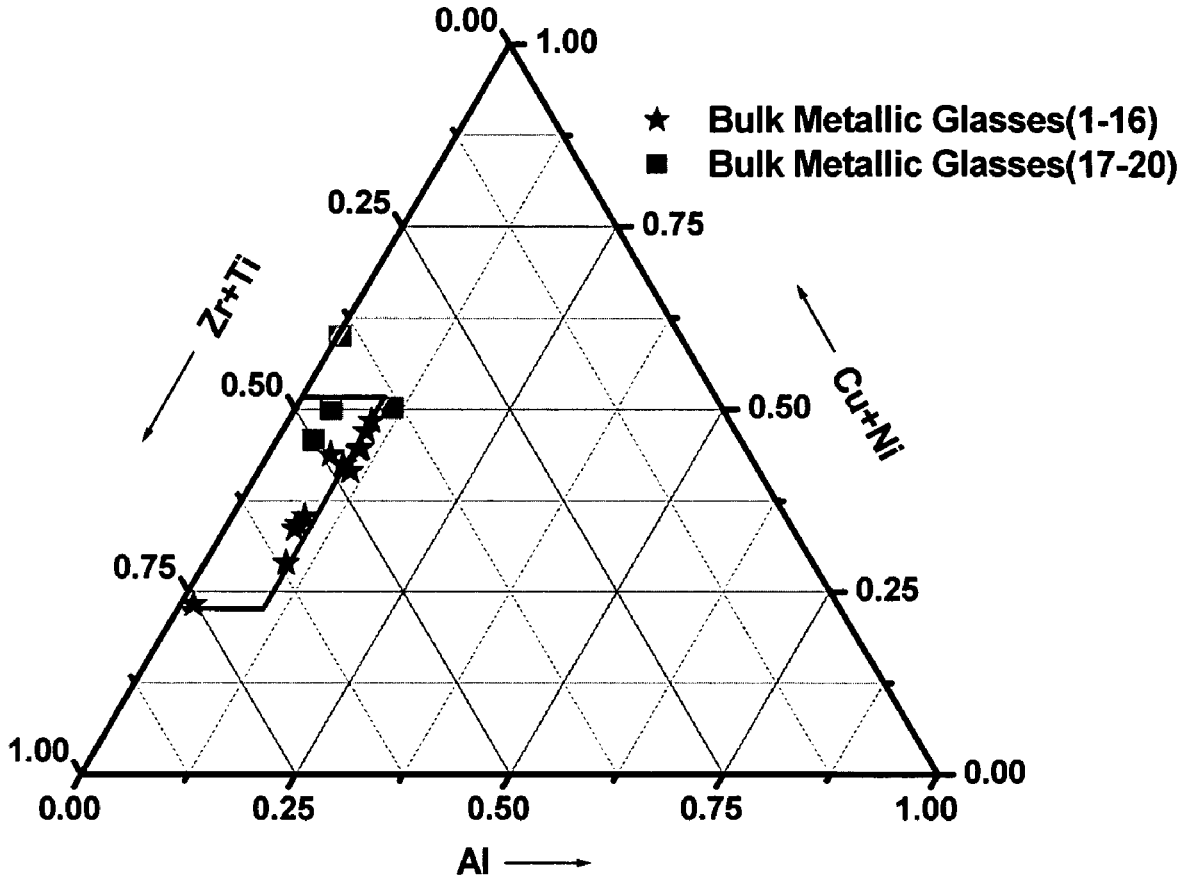
FIG. 1 is an alloy composition diagram showing the composition for several bulk metallic glasses in accordance with the present invention.

The present invention provide zirconium-rich bulk metallic glass alloys containing zirconium, aluminum, titanium, copper and nickel. The alloys provide high quality bulk metallic glass pieces with large diameters. The diameters of the pieces are measured as the longest cross-sectional dimension over which the BMG piece has a completely amorphous structure. The use of the term "diameter" to describe the dimensions of the bulk metallic glasses is not intended to limit the pieces to any particular shape (e.g., cylindrical), rather the pieces may have a wide range of shapes, including shapes with irregular boundaries. As used herein the term "piece" may refer to a portion or domain of bulk metallic glass within a larger alloy body or to a discrete bulk metallic glass sample. For example, in some embodiments the bulk metallic glass alloys provided herein form amorphous solids with diameters of at least about 5 mm. This includes bulk metallic glass alloys that form amorphous solids having diameters of at least about 8 mm, at least about 10 mm, and at least about 12 mm. These diameters represent a significant improvement over other Zr-rich bulk metallic glasses which have only been formed with significantly smaller diameters.

One group of bulk metallic glasses in accordance with the present invention comprises amorphous alloys that include about 28 to 45 atomic percent copper, desirably at least 30 atomic percent copper, about 1 to 12 atomic percent nickel, about 1 to 15 atomic percent aluminum, about 0.05 to 10 atomic percent titanium, and about 35 to 70 atomic percent zirconium. In these alloys, the total content of copper and nickel is between about 29 to 50 atomic percent. One sub-group of these bulk metallic glasses includes bulk metallic glasses composed of amorphous alloys that include about 28 to 42 atomic percent copper, about 2 to 12 atomic percent nickel, about 1 to 10 atomic percent aluminum, about 0.05 to 5 atomic percent titanium, and about 40 to 58 atomic percent zirconium. Another sub-group of these bulk metallic glasses includes bulk metallic glasses composed of an amorphous alloy that includes about 30 to 45 atomic percent copper, about 2 to 10 atomic percent nickel, about 5 to 15 atomic percent aluminum, about 0.1 to 8 atomic percent titanium, and about 38 to 52 atomic percent zirconium. Within the latter sub-group the bulk metallic glass may be further characterized by one or more of the following characteristics: a copper content of about 32 to 42 atomic percent; a nickel content of about 3 to 9 atomic percent; an aluminum content of about 6 to 12 atomic percent; a titanium content of about 0.05 to 6 atomic percent; and a zirconium content of about 40 to 50 atomic percent. Yet another sub-group of these bulk metallic glasses include those composed of an amorphous alloy containing about 28 to 35 atomic percent copper, about 1 to 10 atomic percent nickel, about 5 to 15 atomic percent aluminum, about 1 to 10 atomic percent titanium, and about 40 to 55 atomic percent zirconium. Within this last sub-group the bulk metallic glass alloys may be further characterized by one or more of the following characteristics: a copper content of about 28 to 32 atomic percent; a nickel content of about 2 to 9 atomic percent; an aluminum content of about 8 to 10 atomic percent; a titanium content of about 2 to 7 atomic percent; and a zirconium content of about 45 to 60 atomic percent.

Another group of zirconium-rich bulk metallic glasses provided by the present invention includes those composed of an amorphous alloy containing about 0.1 to 3 atomic percent copper, about 18 to 25 atomic percent nickel, about 0.5 to 3 atomic percent aluminum, about 5 to 10 atomic percent titanium, and about 50 to 70 atomic percent zirconium. This includes zirconium-rich bulk metallic glass alloys that contain about 1 to 3 atomic percent copper, about 20 to 23 atomic percent nickel, about 1 to 2 atomic percent aluminum, about 7 to 9 atomic percent titanium, and about 65 to 68 atomic percent zirconium.

Other zirconium-rich bulk metallic glasses in accordance with the present invention include those made from amorphous alloys containing about 20 to 30 atomic percent copper, about 0.01 to about 4 atomic percent nickel, about 5 to 15 atomic percent aluminum, about 0.5 to 5 atomic percent titanium, and about 55 to 65 atomic percent zirconium. This includes embodiments where the bulk metallic glasses are made from amorphous alloys containing about 22 to 28 atomic percent copper, about 0.01 to 3 atomic percent nickel, about 7 to 12 atomic percent aluminum, about 1 to 3 atomic percent titanium, and about 57 to 62 atomic percent zirconium.

Another group of zirconium-rich bulk metallic glasses provided by the present invention includes those composed of an amorphous alloy containing about 0.5 to 25 atomic percent copper, about 20 to 60 atomic percent nickel, about 0.1 to 15 atomic percent aluminum, about 10 to 30 atomic percent titanium, and about 15 to 30 atomic percent zirconium. This group includes a subgroup of zirconium-rich bulk metallic glass alloys that contain about 1 to 10 atomic percent copper, about 40 to 60 atomic percent nickel, about 0.1 to 5 atomic percent aluminum, about 18 to 29 atomic percent titanium, and about 20 to 27 atomic percent zirconium. This group further includes a subgroup of zirconium-rich bulk metallic glass alloys that contain about 22 to 26 atomic percent copper, about 24 to 28 atomic percent nickel, about 9 to 13 atomic percent aluminum, about 10 to 15 atomic percent titanium, and about 24-28 atomic percent zirconium.

Unlike other Zr-rich bulk metallic glasses that require the addition of dopants, such as tantalum and beryllium, in order to provide high quality glasses, the present bulk metallic glasses may be free of or substantially free of such dopants. In particular, the bulk metallic glass alloys may be free of or substantially free of beryllium or tantalum. The absence of beryllium is particularly advantageous due to its toxic nature. Furthermore, beryllium is costly. For example, the bulk metallic glass alloys provided herein may be free of or substantially free of other transition metal elements. As used herein, the term "substantially free of" indicates less than about 0.2 atomic percent, desirably less than about 0.1 atomic percent, and more desirably less than about 0.05 atomic percent of additional elements. Additionally, in those embodiments where the bulk metallic glasses are strictly 5-component systems, they are free of other transition metal elements, with the exception that such other elements may be present as impurities in trace amounts (e.g., no more than about 0.01 wt. %).

Although the bulk metallic glass alloys provided herein are preferably pure or substantially pure, the alloys may include small amounts of elements which may be considered contaminants or impurities. For example, small amounts of dissolved oxygen or nitrogen may be present in the bulk metallic glasses. However, the presence of nitrogen or oxygen in the glasses is desirably minimized or eliminated because oxygen and nitrogen may have an adverse effect on the cooling rate of the alloys and hinder glass formation. Thus, the amount of impurities and contaminants in the bulk metallic glasses is desirably limited to no more than about 2 atomic percent, preferably no more than about 1 atomic percent, more preferably no more than about 0.5 atomic percent and still more preferably no more than about 0.1 atomic percent.

The bulk metallic glasses provided herein are substantially completely amorphous materials although small amounts of crystalline phases may be present. When crystalline phases are present, they form a microscopic mixture of amorphous and crystalline phases rather than forming a structure having separate domains of crystalline phases and amorphous phases. Although the preferred bulk metallic glasses are composed of 100% amorphous phase, in some embodiments crystalline phases may account for no more than about 5 volume percent and desirably no more than about 2 volume percent of the bulk metallic glass.

The bulk metallic glasses may be made by any suitable method for creating alloys having an amorphous structure, (i.e., a structure without long-range atomic order). For example, the bulk metallic glasses may be formed using an arc melter where a small sample of alloy having the desired composition is melted several times by an electric arc in a water-cooled copper crucible and followed by casting into a water-cooled copper mold. Once the arc is discontinued, the bulk metallic glass piece solidifies in the copper mold. Alternatively, the alloy may be cast using any of a variety of well known casting techniques. These casting techniques include but are not limited to drop casting, suction casting, melt spinning, planer blow casting, and conventional die casting. The alloys may be cast into a variety of forms including ingots, plates and rods. Using these techniques completely amorphous pieces of bulk metallic glasses may be produced. These pieces may be produced with significant cross-sectional diameters across which the piece is completely amorphous. For example, in some instances, completely amorphous pieces having a cross-sectional diameter of at least about 5 mm may be produced. This includes embodiments where the pieces are completely amorphous and have a cross-sectional diameter of at least about 8 mm, at least about 10 mm, or even at least about 12 mm.

Exemplary embodiments of Zr-rich bulk metallic glasses are provided in the following examples. These examples are presented to illustrate the bulks metallic glasses and assist one of ordinary skill in making the same. These examples are not intended in any way to otherwise limit the scope of the invention.

EXAMPLES

Table 1 shows the compositions for 16 bulk metallic glass alloys (BMG 1-16) made in accordance with the present invention. The numbers in the table represent the concentration of each element in a BMG in atomic percent (at. %). Each of these bulk metallic glass pieces was made in the form of a completely amorphous ingot having a cross-sectional diameter as indicated in the table. Table 1 also shows the compositions for four additional exemplary bulk metallic glasses (BMS 17-20) that may be made in accordance with the this invention. FIG. 1 shows an alloy composition diagram indicating the compositions of BMGs 1-16 (stars) and BMGs 17-20 (squares) from Table 1.

The bulk metallic glass alloys were made (or may be made) according to the following procedure. The quinary alloys were prepared by arc-melting a mixture of the metals having a purity of 99.9 at. %, or higher. Alloys were melted in a Ti-gettered, high-purity argon atmosphere. Each ingot was flipped and remelted at least three times in the arc melter in order to obtain chemical homogeneity. The ingots were then drop cast into copper mold to form bulk metallic glass pieces. The dimensions of the molds ranged to 10 to over 12 mm in diameter with lengths of 20 to 40 mm. The typical cooling rate of copper mold casting was about less than $1\times10^{3}$ K/s. The amorphous nature of the metallic glasses was verified by STOE X-ray Diffraction using Cu—K▯ and Perkin-Elmer DSC7 (Differential Scanning Calorimetry).

TABLE 1

| BMG #. | Al | Cu | Ni | Ti | Zr | Diameter |
|---|---|---|---|---|---|---|
| BMG1 | 0.083 | 0.307 | 0.035 | 0.064 | 0.511 | >10 mm |
| BMG2 | 0.085 | 0.313 | 0.040 | 0.049 | 0.513 | >12 mm |
| BMG3 | 0.107 | 0.328 | 0.087 | 0.026 | 0.452 | >9 mm |
| BMG4 | 0.107 | 0.328 | 0.087 | 0.050 | 0.428 | >2 mm |
| BMG5 | 0.107 | 0.328 | 0.087 | 0.010 | 0.468 | >2 mm |
| BMG6 | 0.107 | 0.328 | 0.087 | 0.000 | 0.478 | >2 mm |
| BMG7 | 0.107 | 0.328 | 0.087 | 0.060 | 0.418 | >2 mm |
| BMG8 | 0.103 | 0.400 | 0.047 | 0.002 | 0.448 | >9 mm |
| BMG9 | 0.015 | 0.018 | 0.214 | 0.085 | 0.667 | >2 mm |
| BMG10 | 0.097 | 0.420 | 0.064 | 0.005 | 0.414 | >2 mm |
| BMG11 | 0.102 | 0.398 | 0.047 | 0.002 | 0.451 | >2 mm |
| BMG12 | 0.094 | 0.393 | 0.031 | 0.003 | 0.479 | >2 mm |
| BMG13 | 0.098 | 0.416 | 0.054 | 0.003 | 0.430 | >2 mm |
| BMG14 | 0.073 | 0.399 | 0.039 | 0.007 | 0.482 | >2 mm |
| BMG15 | 0.082 | 0.293 | 0.043 | 0.063 | 0.520 | >2 mm |
| BMG16 | 0.095 | 0.263 | 0.026 | 0.024 | 0.593 | >2 mm |
| BMG17 | 0.003 | 0.015 | 0.584 | 0.195 | 0.203 | |
| BMG18 | 0.113 | 0.241 | 0.261 | 0.125 | 0.261 | |
| BMG19 | 0.044 | 0.047 | 0.409 | 0.281 | 0.217 | |
| BMG20 | 0.043 | 0.080 | 0.420 | 0.241 | 0.216 | |

Each of the bulk metallic glass alloys in Table 1 may be described individually, according to its own narrow composition, by a range of 2, or even 1, atomic percent cited for each metal in the alloy. Thus, BMG1 may be described as comprising 30 to 31 atomic percent copper, 3 to 4 atomic percent nickel, 8 to 9 atomic percent aluminum, 6 to 7 atomic percent titanium and 51 to 52 atomic percent zirconium. BMG9 may be described as comprising 1 to 2 atomic percent copper, 21 to 22 atomic percent nickel, 1 to 2 atomic percent aluminum, 8 to 9 atomic percent titanium and 66 to 67 atomic percent zirconium.

Figure 2:
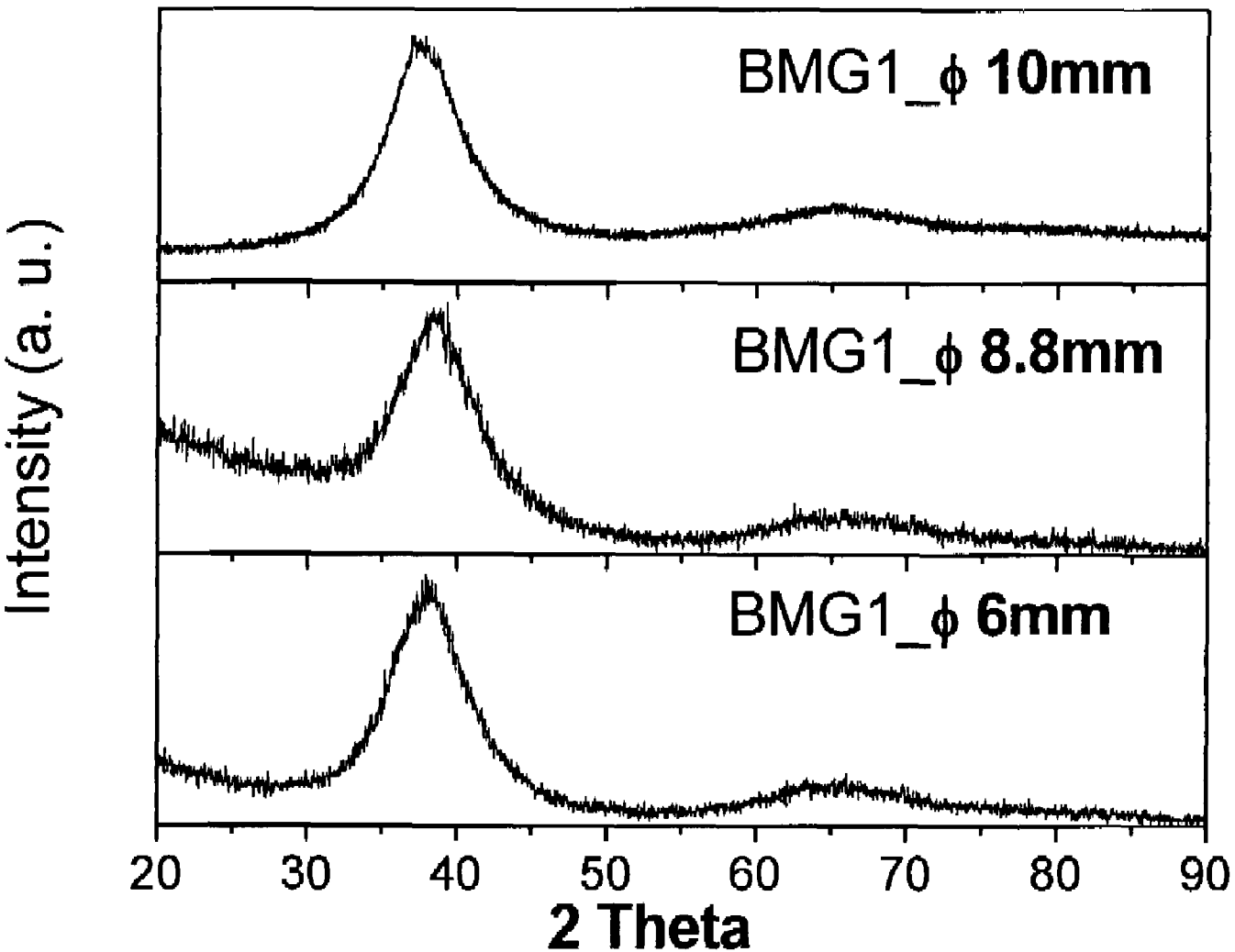
FIG. 2 shows the x-ray diffraction patterns for three bulk metallic glasses in accordance with the present invention.

FIG. 2 is an x-ray diffraction pattern of three bulk metallic glass ingots having the composition of BMG1 in Table 1. The diffraction patterns show no sharp diffraction peaks indicative of crystalline or quasi-crystalline phases.

The bulk metallic glasses provided herein may be used in a broad range of applications including, but not limited to, sporting, military, aeronautical and medical applications. For example, the bulk metallic glasses provided herein may be used to make golf clubs, fishing rods, bicycles, medical instruments such as prosthetic devices, watches, jet engine components, munitions, submarine and ship parts, and aeronautical or aerospace materials.

The invention has been described with reference to specific and illustrative embodiments. However, it should be understood that many variations and modifications may be made while remaining within the scope of the following claims.

What is claimed is:

1. A metallic glass piece comprising an amorphous alloy comprising:

(a) about 28 to 45 atomic percent copper;

(b) about 1 to 12 atomic percent nickel;

(c) about 1 to 15 atomic percent aluminum;

(d) about 0.05 to 10 atomic percent titanium; and (e) about 35 to 70 atomic percent zirconium;

wherein the content of copper plus nickel in the alloy is about 25 to 50 atomic percent and the atomic ratio of copper to nickel in the alloy is at least about 6.5:1, and further wherein the alloy is substantially free of tantalum.

2. The metallic glass of claim 1 wherein the amorphous alloy comprises at least about 30 atomic percent copper.

3. The metallic glass piece of claim 1 wherein the piece has a diameter of at least about 5 mm.

4. The metallic glass piece of claim 1 wherein the piece has a diameter of at least about 10 mm.

5. The metallic glass piece of claim 1 wherein the amorphous alloy comprises no more than about 2 atomic percent of other transition metals.

6. The metallic glass piece of claim 1 wherein the amorphous alloy comprises no more than about 1 atomic percent of other transition metals.

7. The metallic glass piece of claim 1 wherein the amorphous alloy is substantially free of beryllium.

8. The metallic glass piece of claim 1 wherein the amorphous alloy comprises:

(a) about 28 to 42 atomic percent copper;

(b) about 2 to 12 atomic percent nickel;

(c) about 1 to 10 atomic percent aluminum;

(d) about 0.05 to 5 atomic percent titanium; and (e) about 40 to 68 atomic percent zirconium.

9. The metallic glass piece of claim 1 wherein the amorphous alloy comprises:

(a) about 30 to 45 atomic percent copper;

(b) about 2 to 10 atomic percent nickel;

(c) about 5 to 15 atomic percent aluminum;

(d) about 0.1 to 8 atomic percent titanium; and (e) about 38 to 52 atomic percent zirconium.

10. The metallic glass piece of claim 9 wherein the amorphous alloy comprises about 32 to 42 atomic percent copper.

11. The metallic glass piece of claim 9 wherein the amorphous alloy comprises about 3 to 9 atomic percent nickel.

12. The metallic glass piece of claim 9 wherein the amorphous alloy comprises about 6 to 12 atomic percent aluminum.

13. The metallic glass piece of claim 9 wherein the amorphous alloy comprises about 0.05 to 6 atomic percent titanium.

14. The metallic glass piece of claim 9 wherein the amorphous alloy comprises about 40 to 50 atomic percent zirconium.

15. The metallic glass piece of claim 1 wherein the amorphous alloy comprises:

(a) about 28 to 35 atomic percent copper;
(b)about 1 to 10 atomic percent nickel;
(c)about 5 to 15 atomic percent aluminum;
(d)about 1 to 10 atomic percent titanium; and
(e)about 40 to 65 atomic percent zirconium.

16. The metallic glass piece of claim 15 wherein the amorphous alloy comprises about 28 to 32 atomic percent copper.

17. The metallic glass piece of claim 15 wherein the amorphous alloy comprises about 2 to 9 atomic percent nickel.

18. The metallic glass piece of claim 15 wherein the amorphous alloy comprises about 8 to 10 atomic percent aluminum.

19. The metallic glass piece of claim 15 wherein the amorphous alloy comprises about 2 to 7 atomic percent titanium.

20. The metallic glass piece of claim 15 wherein the amorphous alloy comprises about 45 to 60 atomic percent zirconium.

21. The metallic glass piece of claim 1 wherein the atomic percent of nickel in the alloy is about 1 to 6.

22. A metallic glass piece comprising an amorphous alloy comprising:

(a) about 0.1 to 3 atomic percent copper;
(b) about 18 to 25 atomic percent nickel;
(c) about 0.5 to 3 atomic percent aluminum;
(d) about 5 to 10 atomic percent titanium; and
(e) about 60 to 70 atomic percent zirconium.

23. The metallic glass piece of claim 22 wherein the amorphous alloy comprises:

(a) about 1 to 3 atomic percent copper;
(b) about 20 to 23 atomic percent nickel;
(c) about 1 to 2 atomic percent aluminum;
(d) about 7 to 9 atomic percent titanium; and
(e) about 65 to 68 atomic percent zirconium.

24. The metallic glass piece of claim 22 wherein the piece has a diameter of at least about 5 mm.

25. The metallic glass piece of claim 22 wherein the piece has a diameter of at least about 10 mm.

26. The metallic glass piece of claim 22 wherein the amorphous alloy comprises no more than about 2 atomic percent of other transition metals.

27. The metallic glass piece of claim 22 wherein the amorphous alloy comprises no more than about 1 atomic percent of other transition metals.

28. The metallic glass piece of claim 22 wherein the amorphous alloy is substantially free of beryllium.

29. The metallic glass piece of claim 22 wherein the amorphous alloy is substantially free of tantalum.

30. The metallic glass piece of claim 22 wherein the amorphous alloy consists essentially of:

(a) about 0.1 to 3 atomic percent copper;
(b) about 18 to 25 atomic percent nickel;
(c) about 0.5 to 3 atomic percent aluminum;
(d) about 5 to 10 atomic percent titanium; and
(e) about 60 to 70 atomic percent zirconium, and further wherein the metallic glass piece has a completely amorphous structure over a diameter of at least about 5 mm.

31. A metallic glass piece comprising an amorphous alloy consisting essentially of:

(a) about 20 to 30 atomic percent copper;
(b) about 0.01 to 4 atomic percent nickel;
(c) about 5 to 15 atomic percent aluminum;
(d) about 0.5 to 5 atomic percent titanium; and
(e) about 55 to 65 atomic percent zirconium, wherein the metallic glass piece has a completely amorphous structure over a diameter of at least about 5 mm.

32. The metallic glass piece of claim 31 wherein the piece has a diameter of at least about 5 mm.

33. The metallic glass piece of claim 31 wherein the piece has a diameter of at least about 10 mm.

34. The metallic glass piece of claim 31 wherein the amorphous alloy comprises no more than about 2 atomic percent of other transition metals.

35. A metallic glass piece comprising an amorphous alloy comprising:

(a) about 0.5 to 25 atomic percent copper;
(b) about 20 to 60 atomic percent nickel;
(c) about 0.1 to 15 atomic percent aluminum;
(d) about 10 to 30 atomic percent titanium; and
(e) about 15 to 30 atomic percent zirconium; wherein the alloy is substantially free of tantalum.

36. The metallic glass piece of claim 35 wherein the amorphous alloy comprises:

(a) about 1 to 10 atomic percent copper;
(b) about 40 to 60 atomic percent nickel;
(c) about 0.1 to 5 atomic percent aluminum;
(d) about 18 to 29 atomic percent titanium; and
(e) about 20 to 27 atomic percent zirconium.

37. The metallic glass piece of claim 35 wherein the piece has a diameter of at least about 5 mm.

38. The metallic glass piece of claim 35 wherein the piece has a diameter of at least about 10 mm.

39. The metallic glass piece of claim 35 wherein the amorphous alloy comprises no more than about 2 atomic percent of other transition metals.

40. The metallic glass piece of claim 35 wherein the amorphous alloy comprises no more than about 1 atomic percent of other transition metals.

41. The metallic glass piece of claim 35 wherein the amorphous alloy consists essentially of:

(a) about 0.5 to 25 atomic percent copper;
(b) about 20 to 60 atomic percent nickel;
(c) about 0.1 to 15 atomic percent aluminum;
(d) about 10 to 30 atomic percent titanium; and
(e) about 15 to 30 atomic percent zirconium, and further wherein the metallic glass piece has a completely amorphous structure over a diameter of at least about 5 mm.

42. A metallic glass piece comprising an amorphous alloy consisting essentially of:

(a) about 22 to 26 atomic percent copper;
(b) about 24 to 28 atomic percent nickel;
(c) about 9 to 13 atomic percent aluminum;
(d) about 10 to 15 atomic percent titanium; and
(e) about 24 to 28 atomic percent zirconium.

* * * * *